US006720300B1

(12) United States Patent
Endlein et al.

(10) Patent No.: US 6,720,300 B1
(45) Date of Patent: Apr. 13, 2004

(54) LIQUID CLEANING AGENT OR DETERGENT COMPOSITION

(75) Inventors: Edgar Endlein, Wrestedt (DE); Mike Kosub, Bruchsal (DE); Karl-Ludwig Gibis, Ludwigshafen (DE); Alexandra Hary, Ludwigshafen (DE); Roger Kaiser, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 09/807,777

(22) PCT Filed: Oct. 20, 1998

(86) PCT No.: PCT/EP99/07951

§ 371 (c)(1),
(2), (4) Date: Aug. 27, 2001

(87) PCT Pub. No.: WO00/24852

PCT Pub. Date: May 4, 2000

(30) Foreign Application Priority Data

Oct. 26, 1998 (DE) ..... 198 49 247

(51) Int. Cl.[7] ..... C11D 3/44
(52) U.S. Cl. ..... 510/417; 510/235; 510/365
(58) Field of Search ..... 510/417, 365, 510/235, 284, 137, 108

(56) References Cited

U.S. PATENT DOCUMENTS

| | | | | | |
|---|---|---|---|---|---|
| 3,718,609 | A | | 2/1973 | Weimer | 252/545 |
| 4,107,067 | A | | 8/1978 | Murphy et al. | 252/135 |
| 4,348,292 | A | * | 9/1982 | Ginn | 510/406 |
| 4,530,781 | A | * | 7/1985 | Gipp | 510/284 |

FOREIGN PATENT DOCUMENTS

| | | | |
|---|---|---|---|
| EP | 0 116 422 A1 | 8/1984 | A61K/7/06 |
| EP | 0 175 485 A2 | 3/1986 | C11D/17/00 |
| GB | 1 247 189 | 9/1971 | C11D/1/02 |
| WO | WO99/47635 | 9/1999 | C11D/17/00 |

OTHER PUBLICATIONS

Copy of PCT International Search Report for PCT/EP99/07951 dated Jun. 14, 2000.

* cited by examiner

*Primary Examiner*—Gregory Webb
(74) *Attorney, Agent, or Firm*—Akin, Gump, Strauss, Hauer & Feld, L.L.P.

(57) ABSTRACT

A liquid cleansing agent or detergent compositions which separates into at least two aqueous phases contains at least one surfactant in a concentration or less than 10% and at least one electrolyte in the concentration of less than 15%. Optionally, the composition contains less than 10% of organic solvent and less than 6% of sodium hexametaphosphate.

26 Claims, No Drawings

LIQUID CLEANING AGENT OR DETERGENT COMPOSITION

BACKGROUND OF THE INVENTION

The present invention relates to a liquid cleansing or detergent composition.

Whether cleaning hard surfaces, in particular in the kitchen or bathroom, or washing soiled fabric, it is a problem to remove both inorganic and organic dirt. Whilst standard surfactants are used to remove most organic dirt, they are less effective and often even totally ineffective in removing inorganic dirt.

In order to remove inorganic dirt, it is therefore necessary to use compounds, usually in aqueous solution, which are suitable for removing or detaching this dirt. Depending on the type of dirt, these compounds may be acid, neutral or alkaline.

In order to dissolve limestone deposits, which are generally attributable to hardness-forming elements in the water, it is preferable to use acid aqueous solutions. Other inorganic dirt, for example containing clay and/or pigment, is more readily removed using aqueous solutions which have a neutral or alkaline pH in aqueous solution.

In either case, however, it has been found that if surfactants are added to aqueous solutions devised as a means of removing inorganic dirt—so as to render them capable of removing organic dirt as well—their effectiveness on inorganic dirt is significantly reduced.

The underlying objective of the invention is to provide a liquid cleansing or detergent composition which also has an efficient cleansing effect on inorganic dirt in spite of containing surfactants.

SUMMARY OF THE INVENTION

This objective is achieved by the invention due to a liquid cleansing or detergent composition, which separates into at lest two aqueous phases when not in use, containing at least one surfactant in a concentration of less than 10% by weight, and containing at least one electrolyte in a concentration of less than 15% by weight provided the composition contains, if any at all, less than 10% by weight of organic solvent and less than 6% by weight of sodium hexametaphosphate.

DETAILS DISCLOSURES

In a preferred embodiment of the invention, surfactant(s) is(are) present in a concentration of between 0.5 and 6% by weight. By preference, the electrolyte(s) is(are) present in a concentration of at least 0.5% by weight.

An alternative of the invention is characterised in that the electrolyte comprises at least one acid and the surfactant is at least partially a surfactant which has a net positive charge given the pH value of the composition.

In a preferred embodiment of this alternative composition proposed by the invention, the concentration of acid is 0.5 to 15% by weight.

In another preferred embodiment of this alternative composition proposed by the invention, the concentration of acid is between 7 and 10% by weight.

It is more especially preferred if the pH value of the composition is below 4.

The acid(s) preferably used in this alternative of the composition proposed by the invention is(are) selected from the group consisting of phosphoric acid, amidosulphonic acid and mixtures thereof.

The preferred surfactant(s) is(are) selected from the group consisting of the quaternary ammonium salts, amines, amine oxides, betaines, sulpho-betaines and mixtures thereof.

In a second alternative proposed by the invention, the composition preferably contains at least one builder or a builder system, at least one alkaline or alkalising compound or mixtures thereof.

By preference, the builder(s) or builder system and the alkaline or alkalising compound(s) is(are) present in a concentration of from 0.5 to 6% by weight.

By particular preference, the surfactant contains, at least in part, at least one cationic surfactant.

In a preferred embodiment, the composition proposed by the invention contains at least one other compound which promotes phase separation.

In one alternative, this may be a compound which promotes phase separation by separating out the salts, for which purpose an alkali metal, earth alkali metal or ammonium salt of an inorganic acid, preferably sodium chloride, may be considered in particular.

In another alternative, the compound to promote phase separation may be one which comprises at least a hydrophobic part and at least an anionic group. By preference, this will be an anionic surfactant, xylol or cumol sulphonic acid or salts or mixtures thereof.

In a preferred embodiment, the composition proposed by the invention is characterised in that it contains at least one perfume and/or a colouring agent.

The invention also relates to the use of a composition, which separates into at least two aqueous phases when not being used and contains at least one surfactant, as a cleanser or detergent.

One of the aforementioned compositions proposed by the invention is used for this purpose.

One particularly preferred embodiment relates to the use of such a composition containing at least one acid for removing limestone deposits and the compositions listed above are preferably also used for this purpose.

Another embodiment of the composition proposed by the invention relates to the use of at least one electrolyte in a liquid cleansing and detergent composition containing at least one surfactant to promote separation of the composition into at least two aqueous phases in order to improve the effectiveness of the composition as a cleansing agent or detergent.

Finally, the invention also relates to the use of xylol or cumol sulphonic acid or salts thereof in a liquid cleansing and detergent composition containing at least one surfactant and at least one acid to promote separation of the composition into at least two aqueous phases for improving the removal of limestone deposits.

Surprisingly, it has been found that by formulating a cleansing agent or detergent to produce a composition that separates into at least two aqueous phases when not in use leads to an unexpected improvement in the cleansing effect of such compositions, and in particular the dual effect against both organic and inorganic dirt. If such a composition is shaken or mixed before or during use, a dispersion is produced enabling a homogeneous application on the surface or substrate. Both on the surface or substrate and in the container, this dispersion separates relatively quickly again in the static state to form separate aqueous phases.

Without wanting to claim such to be the theory, it is assumed that this separation on the surface to be cleaned or the substrate to be cleaned is at least one of the reasons behind the superior cleansing effect that has been discovered, since the negative counter-effect of the compounds used for the different cleaning purposes is at least reduced, in particular the negative influence of the surfactant or surfactants on the effectiveness of the aqueous solutions in cleaning inorganic dirt.

Cleansing or detergent compositions which separate into two or more aqueous phases have not been known before. Such compositions have been previously described in relation to cosmetics and body care products (e.g. shampoo).

For example, GB-A-1 247 189 discloses a liquid composition for use as a shampoo or similar, which contains a surfactant, a water-miscible organic solution and an electrolyte, the relative proportions of the electrolyte and the organic solvent being such that the composition separates into two aqueous phases. When shaken, such compositions form a temporary oil-in-water emulsion and separate into two phases again when left to stand. The compositions need to contain a significant amount of organic solvent and/or electrolyte.

Shampoo compositions which also separate into two aqueous phases when left to stand are known from EP 0 116 422 A1 and 0 175 485 A2. In the case of EP 0 116 422 A1, however, the contents—in addition to surfactant—must include at least 6% of sodium hex ametaphosphate. In the case of EP 0 175 485 A2, the minimum amount of surfactant contained in the composition is 11%. Furthermore, the phase separation, which is the desired objective, is produced only if special complexing agents such as organophosphonates, aminocarboxylic acids, etc., are used.

Surprisingly, it has been found that a liquid cleansing or detergent composition which separates into at least two aqueous phases when left to stand can be obtained using a relatively low content of surfactant and electrolyte, without it being necessary to incorporate additional substances to produce this effect.

Analyses conducted on the two phases of the composition proposed by the invention which occur normally have shown that the top phase contains the surfactant(s), the perfume(s) and optionally the colour agent(s), whilst the remaining ingredients, in particular the electrolyte, are essentially evenly distributed in both phases.

What appears particularly notable is the fact that the composition can be readily adjusted so that the volume of both phases is more or less identical. If the volume of the two phases is unevenly distributed, it may help to add a small quantity of a non-ionic surfactant in order to produce the two phases in the same volumes as required.

In addition to producing the desired phase separation, a surprisingly low content of surfactant and electrolyte and a superior cleansing or detergent effect, it has surprisingly also been found to be of advantage if an optionally used perfume remains more or less exclusively concentrated in the top phase, as mentioned above. This is an advantage because on the one hand the essential purpose of adding a perfume to a composition of this type is to mask other undesirable odours and accordingly, the desired "masking effect" can best be produced in the top phase. On the other hand, in the preferred situation—i.e. when the two phases are of more or less equal volume—if the perfume is concentrated in the top phase, it is possible to reduce the perfume content in the composition as a whole by about a half, which makes for a significant saving in costs, particularly if more expensive perfumes are used.

With the acid compositions proposed by the present invention, apart from the quaternary ammonium salts, amines, amine oxides, betaines and sulpho-betaines mentioned above, all other surfactants which have a net positive charge in a composition of this pH are clearly also suitable.

The acids specified as a means of removing limestone deposits, i.e. phosphoric acid and amidosulphonic acid, are also not the only possible choice. Other acids which might be used include, for example, citric acid, maleic acid, Bernstein's acid, glutaric acid, adipic acid, hydrochloric acid, etc.

Apart from the builders or builder systems or alkaline or alkalising compounds specifically mentioned above, other compounds or mixtures which exhibit the requisite cleansing effect on inorganic stains are also suitable for the present invention. Optionally, cationic surfactants such as those mentioned above may be used in the neutral or alkaline compositions proposed by the invention.

Clearly, the compounds used to promote phase separation are not restricted to the salts or organic compounds specifically mentioned above.

As stated earlier, the addition of a (usually small) quantity of non-ionic surfactant may be helpful in producing the two aqueous phases in more or less equal volumes. Generally speaking, there are no specific restrictions as to the non-ionic surfactants that may be used. Accordingly, all known non-ionic surfactants are suitable, in particular fatty alcohol ethoxylates and alkylphenol ethoxylates.

The selection and quantity of appropriate perfumes and colouring agents will essentially depend on aesthetic factors and the stability of these compounds in the compositions proposed by the invention and present no particular difficulty for the person skilled in this field.

Other advantages and features of the invention will become clear from the examples set out below:

EXAMPLES I TO V

Various compositions as proposed by the invention, with delayed re-soiling, containing an acid are set out in Table I below.

TABLE I

| | % weight | | | | |
|---|---|---|---|---|---|
| Components | Example I | Example II | Example III | Example IV | Example V |
| Amidosulphonic acid | 5 | 5 | 5 | 5 | 5 |
| Phosphoric acid | 3.75 | 3.75 | 3.75 | 3.75 | 3.75 |
| Alkyl($C_{16}$)-trimethyl ammonium chloride | 2.5 | 1.5 | — | — | — |

TABLE I-continued

| Components | % weight Example I | Example II | Example III | Example IV | Example V |
|---|---|---|---|---|---|
| Oleyl-bis-(2-hydroxyethyl)-methylammonium chloride | — | — | 1.9 | — | — |
| Oleyl-bis-(2-hydroxyethyl)-amine | — | — | — | 3 | — |
| Lauryldimethyl amine oxide | — | — | — | — | 1.8 |
| Sodium cumol sulphonate | 1.42 | 0.8 | 0.65 | 0.8 | 0.63 |
| Sodium chloride | — | — | — | 0.5 | — |
| Perfume | 0.15 | 0.15 | 0.15 | 0.15 | 0.15 |
| Colouring (Acid Blue 80) | — | 0.0015 | 0.0015 | 0.0015 | 0.0015 |
| Water | — | Rest | Rest | Rest | Rest |

Although it does not appear to be decisive in terms of the result, the following sequence in which the components are added to water to produce the compositions proposed by the invention clearly seems to produce an advantage:

1. Water
2. Electrolytes (acid(s), sodium chloride)
3. Surfactant(s), perfume(s), colouring agent(s).
4. Sodium cumol sulphonate.

In all cases, the composition distinctly separated into two aqueous phases of more or less equal volume when left to stand and analysis of the individual phases showed that the surfactant, colouring agent and perfume were contained almost exclusively in the top phase whilst the acids and the sodium cumol sulphonate acting as the hydrotrope were more or less evenly distributed in both phases.

The limestone cleansing action of the compositions proposed by the invention were investigated on a test model. As a comparative example, a single-phase composition of essentially the same composition as the compositions of examples I, II and IV respectively was used although the sodium cumol sulphonate was replaced with water.

In order to determine the lime-dissolving capacity of these compounds, a marble cube in a metal basket was completely immersed in the corresponding solution for a period of 30 minutes and the weight loss of the marble cube as a % determined after 1, 2, 5, 10 and 30 minutes.

In each case, the 2-phase formulation homogenised by shaking beforehand was tested in comparison with the single-phase comparative formula with an identical content of acid and surfactant. With the 2-phase formula, care was taken to ensure that a phase separation, which as a rule started after a few minutes, was prevented by moving the basket, which was placed at approximately half height, up and down.

The test method was selected because it provided a good simulation of the actual conditions under which the corresponding detergent would be used.

TABLE 2

| Lime-dissolving capacity as a % over time: | 1 min. | 2 min. | 5 min. | 10 min. | 30 min. |
|---|---|---|---|---|---|
| I | 0.41 | 0.78 | 1.73 | 3.37 | 9.97 |
| I' | 0.41 | 0.72 | 1.93 | 3.07 | 8.37 |

TABLE 2-continued

| Lime-dissolving capacity as a % over time: | 1 min. | 2 min. | 5 min. | 10 min. | 30 min. |
|---|---|---|---|---|---|
| (Comparative example) | | | | | |
| II | 0.51 | 0.98 | 2.27 | 4.40 | 11.08 |
| II' | 0.44 | 0.79 | 1.72 | 3.21 | 8.93 |
| (Comparative example) | | | | | |
| IV | 0.47 | 0.80 | 1.73 | 3.23 | 9.39 |
| IV' | 0.22 | 0.41 | 0.93 | 1.80 | 5.56 |
| (Comparative example) | | | | | |

The results set out above demonstrate that the shaken 2-phase formula is clearly superior in lime-dissolving capacity than the corresponding single-phase formula.

The same positive results were produced when sodium cumol sulphonate was replaced with corresponding quantities of sodium xylol sulphonate.

EXAMPLE VI

Another acid detergent composition proposed by the invention is set out in Table 3 below.

TABLE 3

| Components | % weight Example VI |
|---|---|
| Alkylbenzol sulphonate | 3 |
| Phosphoric acid | 3.7 |
| Amidosulphonic acid | 5 |
| Alkylethoxylate-C9, 11-12EO | 1 |
| Perfume | 0.15 |
| Colouring agent (Acid Blue 80) | 0.0015 |
| Water | Rest |

Instead of a salt of cumol or xylol sulphonic acid, alkylbenzol sulphonate was used as an anionic surfactant in this composition. The tests for lime-dissolving capacity described above in relation to the preceding examples also showed superior performance compared with a corresponding single-phase formula, although the effect was not so significant as using sodium cumol sulphonate or sodium xylol sulphonate.

EXAMPLES VII TO XV

Various neutral or alkaline disinfectant compositions proposed by the invention are set out in Table 4 below.

TABLE 4

| Components | % weight | | | |
|---|---|---|---|---|
| | Example VII | Example VIII | Example IX | Example X |
| Sodium carbonate | 0.75 | 0.75 | — | — |
| Sodium chloride | — | — | — | — |
| Sodium sulphate | 0.75 | 2 | 2 | — |
| Sodium tripolyphosphate | — | 1.5 | — | — |
| Potassium tripolyphosphate | — | — | — | — |
| Phosphonate | — | — | — | — |
| EDTA | — | — | — | — |
| HEDP | — | — | — | — |
| Disilicate | — | — | — | 3 |
| Metasilicate | — | — | 2 | — |
| Didecyldimethyl ammonium chloride[1] | 2.8 | 2.8 | 2.8 | 2.8 |
| $C_{12-16}$-benzyldimethyl ammonium chloride[2] | — | — | — | — |
| Non-ionic surfactant (FAO, C9-11, 6-EO) | 0.75 | — | 2 | 2 |
| Non-ionic surfactant (FAO, C9-11, 2.5-EO | 4 | — | — | — |
| Amphoteric surfactant | — | — | 0.9 | 0.9 |
| Esterquat | 1 | — | — | — |
| Dimethyloleylamine | 1.25 | — | — | — |
| Fatty alcohol $C_7$–$C_9$ | — | — | — | — |
| Cocoamidopropyl betaine | — | 2.7 | — | — |
| $C_{12}$–$C_{14}$ glucamide 50% | — | — | — | — |
| Propylene glycolmethyl ether | — | — | — | — |
| Perfume | 0.2 | 0.2 | 0.2 | 0.2 |
| Colouring agent (Acid Blue 80) | 0.0015 | 0.0015 | 0.0015 | 0.0015 |
| Water | Rest | Rest | Rest | Rest |

| Components | % weight | | | | |
|---|---|---|---|---|---|
| | Example XI | Example XII | Example XII | Example XIV | Example XV |
| Sodium carbonate | 0.5 | 0.75 | 0.75 | 0.75 | 0.75 |
| Sodium chloride | 0.8 | — | — | — | — |
| Sodium sulphate | — | 2 | 3 | 2 | 0.5 |
| Sodium tripolyphosphate | 4 | 1.5 | — | — | — |
| Potassium tripolyphosphate | 4 | — | — | — | 3 |
| Phosphonate | 0.1 | — | — | — | — |
| EDTA | — | — | — | 0.8 | — |
| HEDP | — | — | 1.2 | — | — |
| Disilicate | — | — | — | — | — |
| Metasilicate | — | — | — | — | — |
| Didecyldimethylammonium chloride[2] | — | — | 2.8 | 2.8 | 2.8 |
| ($C_{12-16}$-benzyldimethyl ammonium chloride)[2] | 0.4 | — | — | — | — |
| Non-ionic surfactant (FAO, C9–11, 6-EO) | — | 0.5 | 2 | 2 | 0.75 |
| Non-ionic surfactant (FAO, C9–11, 2.5-EO | — | — | — | | — |
| Amphoteric surfactant | 3 | 2.55 | 0.9 | 0.9 | 0.9 |
| Esterquat | — | — | 0.5 | — | — |
| Dimethyloleylamine | — | — | — | — | 1.5 |
| Fatty alcohol $C_7$–$C_9$ | — | 2 | 2 | 2 | — |
| Cocoamidopropyl betaine | — | — | — | — | — |
| $C_{12}$–$C_{14}$ glucamide 50% | 3 | — | — | — | — |
| Propylene glycolmethyl ether | 3 | — | — | — | — |
| Perfume | 0.2 | 0.2 | 0.2 | | 0.2 |
| Colouring agent (Acid Blue 80) | 0.0015 | 0.0015 | 0.0015 | 0.0015 | 0.0015 |
| Water | Rest | Rest | Rest | Rest | Rest |

[1]ca. 70% solution in isopropanol
[2]ca. 50% solution in isopropanol

In all cases, there was a clear separation of the composition into two aqueous phases of approximately equal volume when left to stand and an analysis of the individual phases indicated that the surfactant, colouring agent and perfume were almost exclusively contained in one phase whilst the other components, in particular the builder or alkaline compound, were more or less equally divided between the two phases.

The cleansing effect of the two compositions proposed by the invention were investigated on a test model. The test structure was as follows:

The following ingredients were mixed in the specified sequence and stirred for two hours:

15% clay, screened through 250 $\mu$m
10% Myritol7 318 (capryl-capringlyceride, Henkel)
10% corn starch
15% $CaCO_3$
10% $FeCl_2$
40% tap water.

Prior to use, the mixture was thoroughly stirred again in order to produce a homogeneous solution. This standard dirt (referred to as "pigment/grease dirt") was applied using an appropriate coating device in a coating thickness of 100 $\mu$m on enamel strips (10×40 cm). The strips were stored at room temperature for at least the days in order to obtain a uniform drying process.

The cleaning tests were conducted using an automatic wiping machine (Erichsen). 2 ml of the composition proposed by the invention were applied in each case on a damp sponge. The number of wiping cycles was 20.

The cleaned strips were assessed visually. Taking the bottom phase essentially containing no surfactant as a reference value, the top phase, which contained surfactant, exhibited a markedly superior cleansing effect and a significantly superior cleansing effect for the shaken mixture.

Cleansing performance (10 = 100% clean; 1 = no cleansing effect)

| Examples | XII | XIII | XIV | XV |
|---|---|---|---|---|
| Shaken mixture | 8 | 9 | 9 | 8 |
| Bottom phase | 6 | 7 | 8 | 6 |
| Top phase | 3 | 2 | 6 | 3 |

The features of the invention disclosed in the description above and in the claims may essentially be used individually or in any combination to implement the invention in its various embodiments.

What is claimed is:

1. Liquid detergent or cleansing composition which separates into two aqueous phases when left to stand, containing at least one surfactant in a concentration of less than 10% by weight, containing at least one electrolyte in a concentration of less than 15% by weight, and containing at least one other compound which promotes phase separation and comprises at least one hydrophobic element and at least one anionic group, provided the composition contains, if any at all, less than 10% by weight of organic solvent and less than 6% by weight of sodium hexametaphosphate.

2. Composition according to claim 1, wherein the surfactant(s) is (are) present in a concentration of 0.5 to 6% by weight.

3. Composition according to claim 1, wherein the electrolyte(s) is (are) present in a concentration of at least 0.5% by weight.

4. Composition according to claim 1, wherein the electrolyte comprises at least one acid and the surfactant contains at least partially at least one surfactant which has a net positive charge given the pH value of the composition.

5. Composition according to claim 4, wherein the concentration of acid is 0.5 to 15% by weight.

6. Composition according to claim 5, wherein the concentration of acid is 7 to 10% by weight.

7. Composition according to claim 4, wherein the pH value of the composition is below 4.

8. Composition according to claim 4, wherein the acid(s) is (are) selected from the group consisting of phosphoric acid, amidosulphonic acid and mixtures thereof.

9. Composition according to claim 4, wherein the surfactant(s) is (are) selected from the group consisting of quaternary ammonium salts, amines, amine oxides, betaines, sulpho-betaines and mixtures thereof.

10. Composition according to claim 1, wherein the composition contains at least one builder or a builder system, at least one alkaline or alkalizing compound or mixtures thereof.

11. Composition according to claim 10, wherein the builder(s) or the builder system or the alkaline or alkalizing compound(s) is (are) present in a concentration of from 0.5 to 6% by weight.

12. Composition according to claim 10, wherein the surfactant is at least partially a cationic surfactant.

13. Composition according to claim 1, wherein the compound promotes phase separation by separating the salts.

14. Composition according to claim 13, wherein the compound is an alkali metal, earth alkali metal or ammonium salt of an inorganic acid.

15. Composition according to claim 14, wherein the compound is sodium chloride.

16. Composition according to claim 1, wherein the compound contains an anionic surfactant, xylol or cumol sulphonic acid or salts or mixtures thereof.

17. Composition according to claim 1, wherein it contains at least one perfume.

18. Composition according to claim 1, wherein it contains at least one coloring agent.

19. A method for cleaning a hard surface which comprises applying thereto a liquid detergent or cleansing composition which separates into two aqueous phases when left to stand, containing at least one surfactant in a concentration of less than 10% by weight, containing at least one electrolyte in a concentration of less than 15% by weight, and containing at least one other compound which promotes phase separation and comprises at least one hydrophobic element and at least one anionic group, provided the composition contains, if any at all, less than 10% by weight of organic solvent and less than 6% by weight of sodium hexametaphosphate.

20. A method according to claim 19 in which the composition additionally comprises at least one acid for removing limestone deposits.

21. A method according to claim 20 in which the acid is amidosulphonic acid.

22. A method for washing soiled fabric which comprises immersing said fabric in an aqueous washing medium which comprises a liquid detergent or cleansing composition which separates into two aqueous phases when left to stand, containing at least one surfactant in a concentration of less than 10% by weight, containing at least one electrolyte in a concentration of less than 15% by weight, and containing at least one other compound which promotes phase separation and comprises at least one hydrophobic element and at least one anionic group, provided the composition contains, if any at all, less than 10% by weight of organic solvent and less than 6% by weight of sodium hexametaphosphate.

23. A method according to claim 22 in which the composition additionally comprises at least one acid for removing limestone deposits.

24. A method according to claim 23 in which the acid is amidosulphonic acid.

25. A liquid cleansing and detergent composition containing at least one surfactant, an electrolyte which promotes the separation of said composition into at least two aqueous phases, and containing at least one other compound which promotes phase separation and comprises at least one hydrophobic element and at least one anionic group.

26. A liquid cleansing and detergent composition which comprises at least one surfactant, at least one limestone-removing acid and xylol and/or cumol sulphonic acid or salts thereof to promote separation of said composition into at least two aqueous phases.

* * * * *